US008615813B1

(12) United States Patent
Bryan et al.

(10) Patent No.: US 8,615,813 B1
(45) Date of Patent: Dec. 31, 2013

(54) APPARATUS FOR PREVENTING SUN DAMAGE OF A CAR OCCUPANT

(76) Inventors: Edward James Bryan, Grass Valley, CA (US); Sheila Rachel Bryan, Grass Valley, CA (US)

( * ) Notice: Subject to any disclaimer, the term of this patent is extended or adjusted under 35 U.S.C. 154(b) by 0 days.

(21) Appl. No.: 13/565,086

(22) Filed: Aug. 2, 2012

Related U.S. Application Data

(60) Provisional application No. 61/515,883, filed on Aug. 6, 2011.

(51) Int. Cl.
*A41D 13/08* (2006.01)

(52) U.S. Cl.
USPC ..... 2/16; 2/88

(58) Field of Classification Search
USPC ..... 2/16, 88, 87, 115, 116, 114, 113, 125, 2/126, 51, 46
See application file for complete search history.

(56) References Cited

U.S. PATENT DOCUMENTS

| | | | | | |
|---|---|---|---|---|---|
| 417,028 | A * | 12/1889 | Horn | 296/81 |
| 1,424,215 | A * | 8/1922 | Rowe | 296/81 |
| 1,796,782 | A * | 3/1931 | Gasperini | 2/87 |
| 1,833,109 | A * | 11/1931 | Day | 2/87 |
| 5,056,157 | A * | 10/1991 | Pryor | 2/16 |
| 5,357,633 | A * | 10/1994 | Rael | 2/16 |
| 6,052,824 | A * | 4/2000 | May | 2/16 |
| 7,694,348 | B1 * | 4/2010 | Smith | 2/16 |

* cited by examiner

*Primary Examiner* — Gloria Hale
(74) *Attorney, Agent, or Firm* — Plager Schack LLP

(57) ABSTRACT

An apparatus prevents sun damage of a car occupant while keeping the occupant cool. The apparatus comprises a material mechanically coupled to a pocket and a safety belt attachment device. The material is sufficiently large to cover the occupant's fingers, hand, arm and shoulder. The occupant can place the safety belt attachment device over a safety belt and can insert fingers into the pocket allowing an air conditioner vent or natural air to cool the occupant while the material protects the occupant from ultraviolet light.

3 Claims, 2 Drawing Sheets

APPARATUS FOR PREVENTING SUN DAMAGE OF A CAR OCCUPANT

CROSS REFERENCE TO RELATED APPLICATIONS

This application claims priority to U.S. Provisional Application 61/515,883 filed on Aug. 8, 2011.

FIELD OF THE INVENTION

This invention relates to accessories that can be attached to automobiles.

BACKGROUND OF THE INVENTION

The sun has burned human skin for a long time. Prior art solutions to this problem as it relates to occupants of automobiles have been insufficient or inadequate for the reasons stated below.

U.S. Patent application 2007/0028345 filed by McCarty teaches a sleeve that can be attached to an individual in order to have the sleeve absorb sunlight on the individual's arm. McCarty teaches that "any fabric can be used such as vinyl or leather . . . ." It is well known that heavy fabrics immediately adjacent to the skin can cause heat and excessive sweating making the solution untenable. McCarty proposes to solve the problem it creates with a "breathable fabric . . . ." Even assuming this works, McCarty does not teach how to protect the hand or leg. The skin on the hand is thinner than the skin on the arm and can therefore burn much faster. McCarty's ending its device at "the cuff" is wrongheaded.

U.S. Patent Application 2010/0024088 filed by Griefer largely follows the teaching of McCarty, but adds a section covering the wrist, but oddly not the finger tips. Like McCarty, no solution is offered on how to keep the occupant both cool and out of the sun and no solution is offered for protecting the legs.

U.S. Pat. No. 6,029,278 issued to Lopez picks up on the faults of McCarty and teaches a device that can be attached with a series of hook and loop fasteners that can cover a occupant's head, neck, arm and hand to avoid sun damage. However, Lopez does not explain how an occupant can remain cool when wrapped in its contraption. Like McCarty, Lopez relies on a "breathable material such as cotton" alone. The present invention solves the Lopez problem with a fabric that can work in connection with an automobile air conditioning vent or natural air to keep the occupant cool.

BRIEF SUMMARY OF THE INVENTION

An apparatus prevents sun damage of a car occupant while keeping the occupant cool. The apparatus comprises a material mechanically coupled to a pocket and a safety belt attachment device. The material is sufficiently large to cover the occupant's fingers, hand, arm and shoulder. The occupant can place the safety belt attachment device over a safety belt and can insert fingers into the pocket allowing an air conditioner vent or natural air to cool the occupant while the material protects the occupant from ultraviolet light.

BRIEF DESCRIPTION OF THE SEVERAL VIEWS OF THE DRAWINGS

Figure 1:
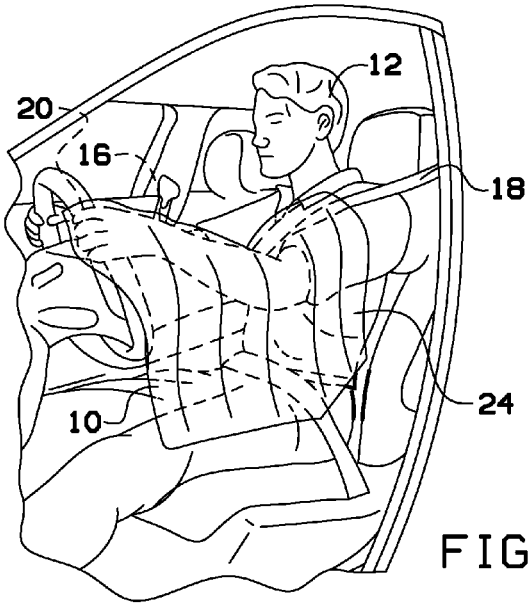

Having thus described the invention in general terms, reference will now be made to the accompanying drawings, which are not necessarily drawn to scale, and wherein:

FIG. 1 is a perspective view of the invention shown in use with car door intentionally removed for illustrative purposes.

Figure 2:
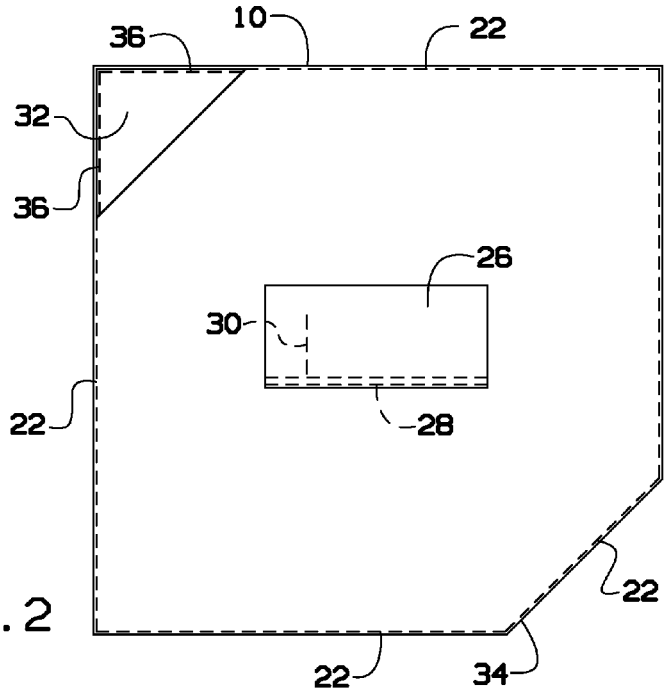

FIG. 2 is a top view of the invention illustrating general layout.

Figure 3:
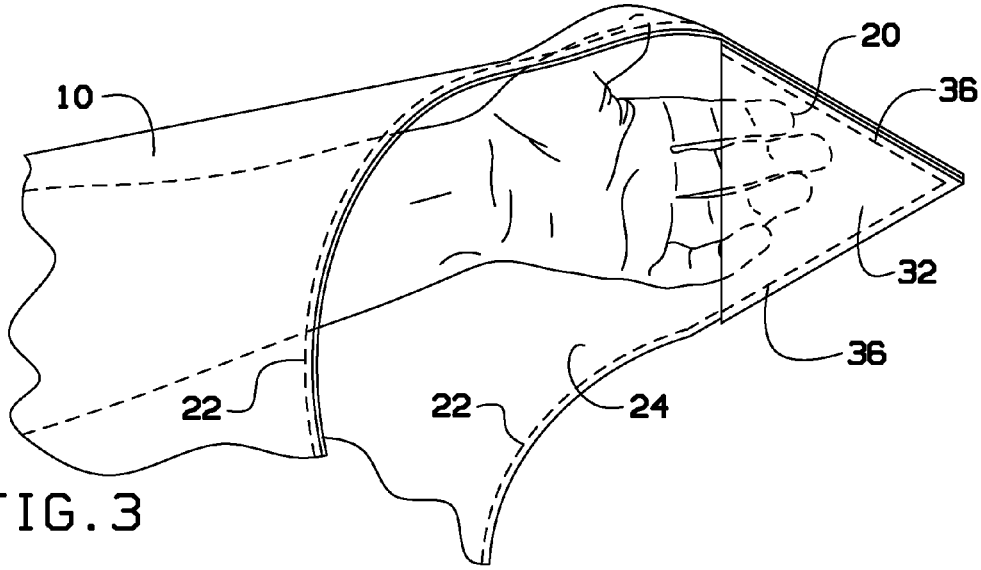

FIG. 3 is a perspective detail view of the invention shown in use illustrating the fingers placed in a pocket.

Figure 4:
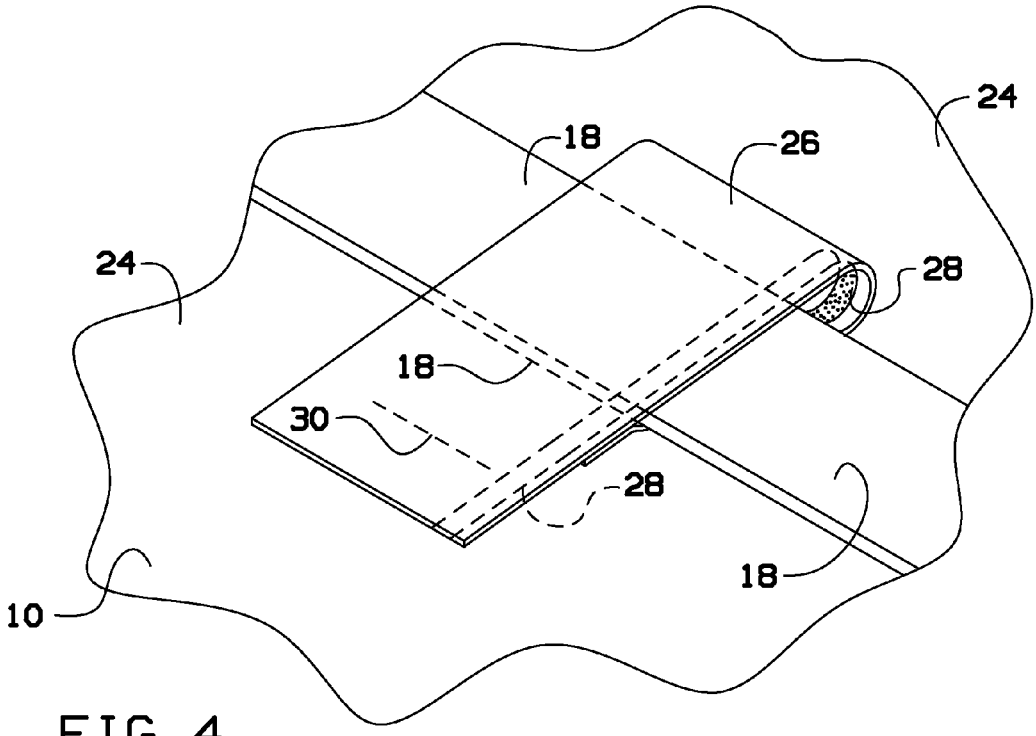

FIG. 4 is a perspective detail view of the invention shown in use illustrating the safety belt secured by item the safety belt attachment section.

DETAILED DESCRIPTION OF THE INVENTION

Embodiments of the present invention overcome many of the obstacles associated with keeping a car occupant cool and safe from the sun, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. Occupant 12 is an occupant in an automobile who is retrained by safety belt 18. Occupant 12 desires to limit exposure to the sun and remain cool. Occupant 12 can accomplish this with apparatus for preventing sun damage of a car occupant while keeping an occupant cool 10. Apparatus for preventing sun damage of a car occupant while keeping an occupant cool 10 is made of material 24. Note that material 24 can be of sufficient size to cover the knees of occupant 12. This can prevent sun exposure of the legs of occupant 12 a feature wholly ignored by the prior art.

Occupant 12 is confronted with a duality of problems. The first is the potential for damage from the sun particularly from ultraviolet light. Ultraviolet (UV) light is electromagnetic radiation with a wavelength shorter than that of visible light, but longer than X-rays, that is, in the range 10 nm to 400 nm, corresponding to photon energies from 3 eV to 124 eV. UV light, particularly UV B which is in the range of 315 to 280 nm corresponding to photon energies from 3.94-4.43 eV can cause sunburns and skin cancer for reasons that are well known in the art.

The second problem is the uncomfortable nature of the heating of skin within clothes and this is the problem largely ignored by the prior art. The present invention solves this problem by configuring apparatus for preventing sun damage of a car occupant while keeping an occupant cool 10 such that an air conditioning vent commonly found nearest the door on the front panel of a car can push air through apparatus for preventing sun damage of a car occupant while keeping an occupant cool 10 and cool the occupant. McCarty, Griefer and Lopez are completely wrongheaded in their reliance in air being pushed over their devices instead of the present invention which pushes air through and under the device.

Apparatus for preventing sun damage of a car occupant while keeping an occupant cool 10 comprises a square piece of material 24. Material 24 has corner 34 removed and transported to pocket 32 where corner 34 is mechanically coupled to material 24 by fingertip pocket stitch 36 creating pocket 32.

Apparatus for preventing sun damage of a car occupant while keeping an occupant cool 10 further comprises safety belt attachment section 26. Safety belt attachment section 26 can be attached to safety belt 18 as shown with fastener 28 and attachment stitching 30 as shown in more detail in FIG. 4.

FIG. 3 shows how occupant 12 can place fingers 20 into pocket 32. Material 24 is configured such that occupant 12 can wear apparatus for preventing sun damage of a car occupant while keeping an occupant cool 10 on fingers 20. Material 24 has edges comfortably sewn with stitching 22 and pocket 32 sewn with fingertip pocket stitch 36. Note that an opening exists between fingers 20 and the elbow of occupant 12. This enables an air conditioning vent or natural air to blow air into apparatus for preventing sun damage of a car occupant while keeping an occupant cool 10 keeping occupant 12 cool and protected from the sun.

FIG. 4 shows the attachment of safety belt attachment section 26 to safety belt 18 in more detail. Safety belt attachment section 26 is mechanically coupled to material 24 by attachment stitching 30. Safety belt attachment section 26 can be wrapped around safety belt 18 and then coupled to itself by fastener 28. In some embodiments, fastener 28 can be a hook and loop fastener.

While these drawings have focused on the driver of an automobile as an occupant, a passenger can use this device as well in the same manner.

In the preferred embodiment material 24 will be made of a known fabric preferably a hypoallergenic fabric to assist occupants with allergies. Attachment section 26 should be made of a soft fabric material such us Sherpa, imitation sheep skin, or other material of similar type which is sufficiently soft to cushion occupant 12.

Pocket 32 can be used to hold material 24 on the sun visor of the automobile to shade the side of the face of a car occupant. Apparatus for preventing sun damage of a car occupant while keeping an occupant cool 10 can also be used to cover the steering wheel of an automobile while parked under the sun to keep it cool. Apparatus for preventing sun damage of a car occupant while keeping an occupant cool 10 can also be taken out of the automobile and used as a covering to block ultraviolet light from burning the back of the neck, shoulders, or legs by draping over the specified body parts while outside the automobile.

What is claimed is:

1. An apparatus for wear by a human occupant of a car with a safety belt to prevent sun damage to the human occupant while also keeping the human occupant cool; the apparatus comprising:

a fabric section comprising a corner;

a pocket sewn to the corner of the fabric section wherein the pocket accommodates at least some of the human occupant's fingers;

a safety belt attachment section attached to the fabric section and attached to a fastener; wherein the safety belt attachment section is wrapped around the safety belt and then coupled to itself by the fastener;

the material covers the human occupant's fingers, hand, arm and shoulder on one side of the human occupant's body;

wherein the occupant places the safety belt attachment section over a safety belt and inserts the human occupant's fingers into the pocket thereby allowing an air conditioning vent in the car or natural air about the car to cool the occupant while the fabric section protects the human occupant from ultraviolet light.

2. The apparatus of claim 1, the material is sufficiently large to cover knees of the occupant in order to protect the knees from the sun damage.

3. The apparatus of claim 1, the safety belt attachment section is made from imitation sheepskin.

* * * * *